United States Patent [19]

Kapur et al.

[11] Patent Number: 4,710,761

[45] Date of Patent: Dec. 1, 1987

[54] WINDOW BORDER GENERATION IN A BITMAPPED GRAPHICS WORKSTATION

[75] Inventors: Rajan N. Kapur, Summit; Edward S. Szurkowski, Maplewood, both of N.J.

[73] Assignee: American Telephone and Telegraph Company, AT&T Bell Laboratories, Murray Hill, N.J.

[21] Appl. No.: 753,270

[22] Filed: Jul. 9, 1985

[51] Int. Cl.[4] ..... G09G 1/16

[52] U.S. Cl. ..... 340/721; 340/724; 340/723; 340/799

[58] Field of Search ..... 340/721, 723, 724, 729, 340/747, 799

[56] References Cited

U.S. PATENT DOCUMENTS

| | | | |
|---|---|---|---|
| 4,451,895 | 5/1984 | Sliwkowski . | |
| 4,490,797 | 12/1984 | Staggs et al. . | |
| 4,533,910 | 8/1985 | Sukonick et al. | 340/721 |
| 4,550,315 | 10/1985 | Bass et al. | 340/723 |

FOREIGN PATENT DOCUMENTS

| | | | |
|---|---|---|---|
| 0156116 | 10/1985 | European Pat. Off. | 340/721 |
| 2030827 | 4/1980 | United Kingdom | 340/721 |

OTHER PUBLICATIONS

Steven Dines et al, "Data Handling for Advanced Vdu Facilities," *Electronic Product Design* (Mar. 1984), pp. 53–58.

Leo J. Guibas et al, "A Language for Bitmap Manipulation," *ACM Transactions on Graphics*, vol. 1, No. 3 (Jul. 1982), pp. 191–214.

Gary C. Staas, "New Display Station Offers Multiple Screen Windows and Dual Data Communications Ports," *Hewlett-Packard Journal* (Mar. 1981), pp. 3–8.

Srinivas Sukumar et al, "Hardware and Firmware Support for Four Virtual Terminals in One Display Station," *Hewlett-Packard Journal* (Mar. 1981), pp. 13–15.

Richard Palm et al, "LSI Building Blocks Enhance Performance of Compact Displays," *Electronic Design* (Jul. 12, 1984), pp. 175–185.

*Primary Examiner*—Gerald L. Brigance

*Attorney, Agent, or Firm*—Jerry W. Herndon

[57] ABSTRACT

Window border generating circuitry in a bitmapped graphics workstation. The workstation includes a host processor, a raster scanned graphics display device and means for controlling the display of data in one or more windows on the screen of the display device. An individual bitmap is provided for each window. At any given time, display data is retrieved from one of the bitmaps associated with a window presently being refreshed. Circuitry detects when the screen raster is located at a position at which a border of a window is to be displayed. Other circuitry responds to this condition by substituting for the display data from the bitmaps predefined signals for generating the screen borders.

15 Claims, 15 Drawing Figures

HOST PROC
502
P.ADDR
P.DATA
11
16
INTR
WINDOW MANAGER
500
L.BORD
R.BORD
STIPPLE
H.BORD
AEN
A0
A1
CAS
A.OUT
RAS
9
V.SYNC
H.SYNC
CRT
506
DISPLAY MEMORY (256k) X 64
504
64
DATA 508
LATCH
510
MUX SEL
512
DATA0
STIPPLE CIRCUIT
514
516
518
DATA1
FIFO
520
50
51
DATA2
R.BORD
L.BORD
OUTPUT CIRCUIT
522
DATA3

FIG. 9 'IN WINDOW' DETECTOR

WINDOW BORDER GENERATION IN A BITMAPPED GRAPHICS WORKSTATION

TECHNICAL FIELD

The invention relates to the generation of window borders on the displays of bitmapped graphics workstations and the like.

BACKGROUND OF THE INVENTION

"Windowing" is a feature that has recently gained much popularity in the fields of graphics workstations, personal computers, etc. The screen of a display device, such as a workstation monitor, is partitioned into separate rectangular areas (windows), each of which may be assigned to view and/or control the activities of the same or different processes being carried out by an associated processor. Thus, for example, if two windows are defined on a display screen, a user might initiate an output printing process in one window and then activate the second window for on-line text processing while the background printing is progressing.

Performance has been a problem with prior art windowing techniques as applied in the field of bitmapped graphics. The reasons for this and the attempted partial solutions are discussed in a co-pending and simultaneously filed application entitled "Bitmapped Graphics Workstation", Ser. No. 753,271, in the name of R. N. Kapur, and need not be repeated here. Suffice it to say that the primary reason for performance problems has been the need for massive data shuffling as window data is updated. This is caused by the manner in which data is stored for display in prior art techniques. The prior art provides one bitmapped display memory. The states of consecutive bits of the memory reflect the on/off states of consecutive pixels of the display screen. The bit states are sequentially obtained from the memory and sent to the display device as the screen of the device is raster scanned. Thus, as scrolling is performed in one window, for example, large portions of the memory, corresponding to the position of the window on the display screen, must be continually updated.

By contrast, border generation for windows in the prior art bitmapped techniques is relatively simple. Since the one memory contains display data for the entire display screen, all that need be done to generate visual window borders is to set the appropriate bits in the memory to an appropriate state. The border data remains static in the memory as long as the position of the window on the screen is not changed.

Subject matter disclosed in this application and claimed in the above-mentioned co-pending application dramatically achieves an improvement in the performance of bitmapped graphics workstations. This is achieved in part by providing separate bitmaps for each defined window and by fetching screen data from appropriate places in the individual bitmaps as the display screen is refreshed. This technique, while it greatly improves performance, creates difficulty in the generation of window borders. This is because the technique, when used in conjunction with prior art border generating techniques, causes a window to move on the screen as horizontal or vertical scrolling is performed in the window.

SUMMARY OF THE INVENTION

The invention is window border generating circuitry in a bitmapped graphics workstation in which the workstation includes a host processor, a raster scanned graphics display device and means for controlling the display of data in one or more windows on the screen of the display device. An individual bitmap is provided for each window. Other memory is provided for storing parameters defining the screen boundaries of each window. Circuitry continually identifies which, if any, window is presently being refreshed on the screen. At any given time, display data is retrieved from one of the bitmaps associated with a window presently being refreshed. The location in the bitmaps from which the display data is obtained is determined by the window boundary definitions and by the position of the raster on the screen. Circuitry is provided for detecting when the screen raster is located at a position at which a border of a window is to be displayed. Other circuitry responds to this condition by substituting for the display data from the bitmaps predefined signals for generating the screen borders.

For handling multiple windows, a depth indication, i.e., an indication of how the windows are visually stacked with respect to each other, is stored for each window. Means are provided for using the depth indications in conjunction with raster position data to determine a "winning" window, if any, at each position of the screen. This determines the bitmap from which display data is obtained for each such position. Access means is provided to allow the host processor to write display data into the bitmaps.

In the preferred embodiment, windows are defined by storing addresses identifying relative horizontal screen positions of the vertical boundaries of the windows and raster line numbers identifying the horizontal boundaries of the windows. The individual bitmaps are illustratively contained in a single display memory. Display memory address generating means are provided which generates an address in an appropriate bitmap at any given time.

Border detection circuits associated with the individual windows generate border detection signals when a border area of a window with which an individual detection circuit is associated is being refreshed on the screen. A left vertical border detection signal is generated as a window is entered from the left. A right vertical border detection signal is generated as a window is exited on the right. Horizontal border detection signals are generated as appropriate. The border detection signals and bitmap data obtained for display are delayed to allow for border generation. Specifically, bitmap data and the horizontal and right vertical border detection signals are delayed by a first predefined time interval. Left vertical border detection signals are delayed by a second time interval which is less than the first interval by at least the raster scan time required to scan the horizontal width of a vertical border on the screen. Output circuits respond to the delayed border detection signals to substitute border generation data signals into the delayed bitmap data. The difference in delays of the left and right vertical border detection signals allow the output circuits to generate properly and insert into the delayed bitmap the vertical border generation signals.

DETAILED DESCRIPTION

Figure 1:
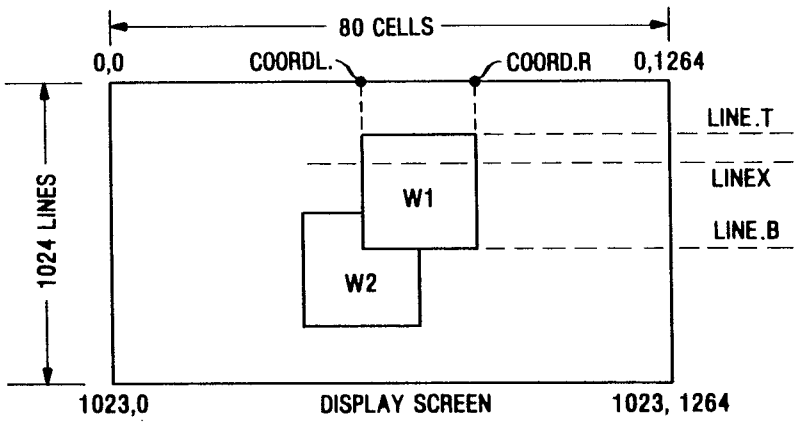
FIG. 1 is an illustration of a display screen with two windows as they might appear in the prior art and with this invention.

FIG. 1 illustrates the face of a display screen as it might appear in an implementation of the present invention. By way of example, the screen comprises 1024 scan lines in the vertical direction with each line made up of 80 horizontal cells. Without limitation, each cell is the atomic unit of horizontal display in this illustrative embodiment and is composed of 16 horizontal pixels. The upper left corner of the screen is assumed to have an address of line 0 and pixel 0 (or 0,0). Similarly, the upper right corner of the screen is assumed to have a line and pixel address of 0,1264 (line 0, pixel **16*79**), and so on. In the embodiment to be described, up to sixteen different work windows may be defined anywhere on the screen by a user. Different and independent work processes may typically be associated with each window. Processes associated with some windows may be idle, for example, while none, one or more processes associated with other windows are active. A user might, for example, activate an output printing process for data associated with one window and then change to another window for interactive editing while the printing is proceeding.

For illustration, the screen in FIG. 1 is assumed to be partitioned into two overlapping work windows W1 and W2. With reference to W1, the projection of its upper-left corner onto the top scan line 0 gives a left cell coordinate COORD.L for W1. Similarly, the projection of the upper-right corner onto line 0 gives a right cell coordinate address COORD.R for W1. Parameters LINE.T and LINE.B define the respective upper and lower line addresses of the window. Equivalent parameters are associated with each defined window.

Figure 2:
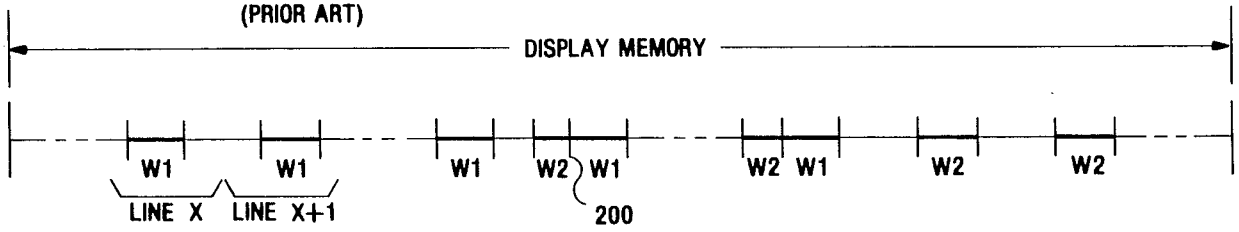
FIG. 2 (PRIOR ART)
FIG. 2 is an illustration of how display data is stored in a single bitmap in the prior art.

FIG. 2 illustrates the manner in which window data is stored for the screen of FIG. 1 by the prior art. Individual bits of a contiguous display memory correspond one-for-one with the sequential pixels of the screen as each line is raster scanned. Thus, one contiguous segment of the memory contains the display data for a line X (shown in FIG. 1) of the screen. Part of the data in this segment corresponds to W1. A next contiguous segment contains data for line X+1, part of which corresponds to W1, and so on. It is easy to see how this leads to complexities, for example, when at 200 of FIG. 2, W1 and W2 begin to overlap. A scrolling of W2, for example, has to take into account the overlapping of the windows and provide for moving "hidden" data in W2 (data that is under W1) into and out of the display memory as scrolling proceeds.

Figure 3:
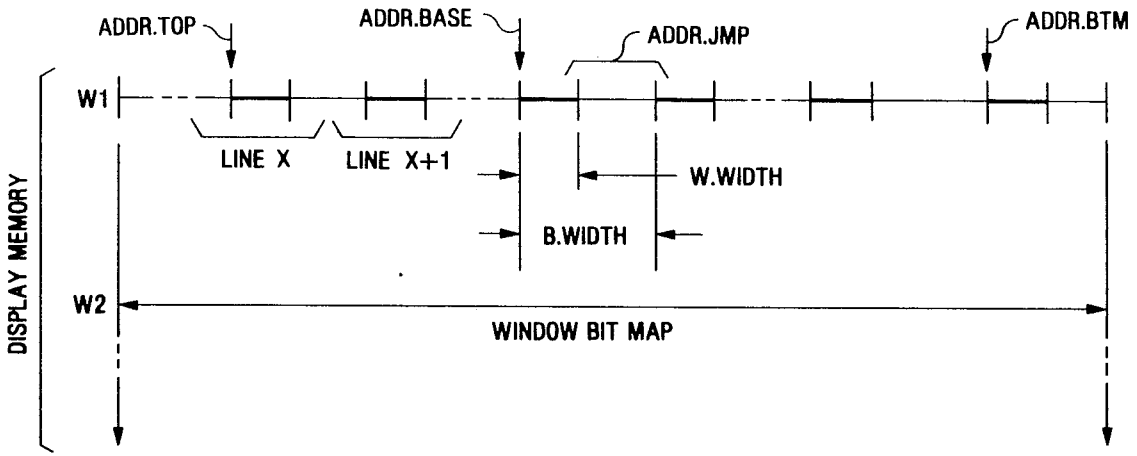
FIG. 3 illustrates how display data is stored in individual window bitmaps in the preferred embodiment of the present invention.

By contrast, FIG. 3 illustrates the manner that display data is handled in this invention. A display memory is partitioned into a plurality of contiguous segments, each of which pertain to a potential window. Henceforth, we will refer to the entire memory as the display memory and the individual contiguous segments for each window as a bitmap. The data in each bitmap is arranged in a fashion similar to that of FIG. 2. With reference to the bitmap corresponding to W1, for example, the data to be displayed in successive lines of the window at a given time are shown in bold in FIG. 2. The arrangement of FIG. 3 reduces many of the problems of data shuffling inherent in the arrangement of FIG. 2. For example, "hidden" data is maintained in the window bitmap memory and need not be relocated as scrolling proceeds. Only that data in a window bitmap that is to be displayed is addressed at the appropriate time, as will be seen. Preferably, each bitmap is larger than that required for the full display screen. This allows any window to be any size up to the size of the screen, or to be located anywhere on the screen and also to be scrolled horizontally and vertically.

Figure 4:
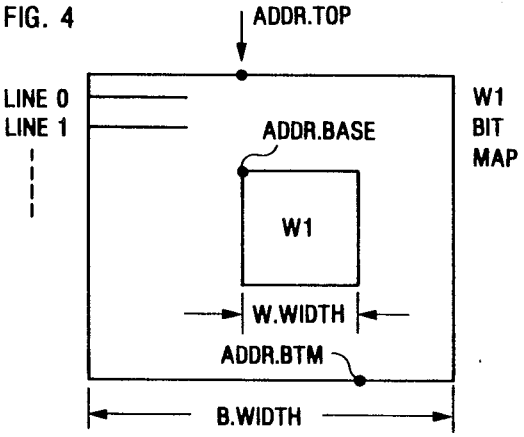
FIG. 4 shows an illustrative individual bitmap in the present invention with the data corresponding to individual raster lines vertically stacked so as to visually resemble a display screen.

The parameters ADDR.TOP, ADDR.JMP, ADDR.BASE, ADDR.BTM, W.WIDTH and B.WIDTH refer to addresses, actually relative addresses, in the individual bitmaps, rather than to screen addresses. FIG. 4 is the bitmap for W1 in which the contiguous sections pertaining to the raster lines of a screen are stacked to give the physical appearance of a screen. This presentation of the bitmap makes it easier to envision the significance of the above parameters. At any given time, ADDR.BASE is the bitmap address at the beginning of the window. ADDR.BTM is the last address before the end of the bitmap containing data to be displayed at any given time. ADDR.TOP is the bitmap address containing the next set of line data for the window after that at ADDR.BTM. W.WIDTH is the width of the window in cells. Each cell corresponds to 16 screen pixels. B.WIDTH is the width of the display screen in cells. ADDR.JMP is the cell distance in the bitmap between the right-most edge of the window and the left-most edge of the window in the next screen line (in other words, ADDR.JMP=B.WIDTH−W.-WIDTH). It should be noted here that windows may or may not contain borders, as desired by a user. If a border is defined for a window, the outside edges of the vertical and horizontal borders correspond to the edges of the window in this illustrative embodiment. In other words, a border is contained within its associated window.

Figure 7:
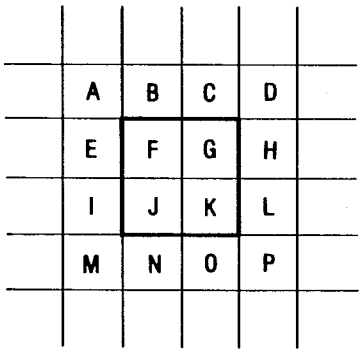
FIG. 7 is a simplified view of a window backlaid with illustrative bitmap data that illustrates the effect of scrolling the window and the corresponding effects on bitmap address generation.

FIG. 7 shows a simplified 2 cell by 2 cell window backlaid with characters to illustrate how scrolling is effected in the invention. The view shows characters F, G, J and K present in the windows. If the window is vertically scrolled down one cell, the host processor 502 modifies the contents of ADDR.BASE by adding to it the number of raster lines assigned to one cell. This causes the window to next display the characters J, K, N and O. If then, the window is scrolled right one cell, ADDR.BASE, ADDR.TOP and ADDR.BTM must be changed. Specifically, the number of pixels in a cell is added to each of these registers. This brings into view the characters K, L, O and P. The modifications to these registers to effect additional scrolling operations should now be evident. It should be noted that no bitmap data transfer is required.

Figure 5:
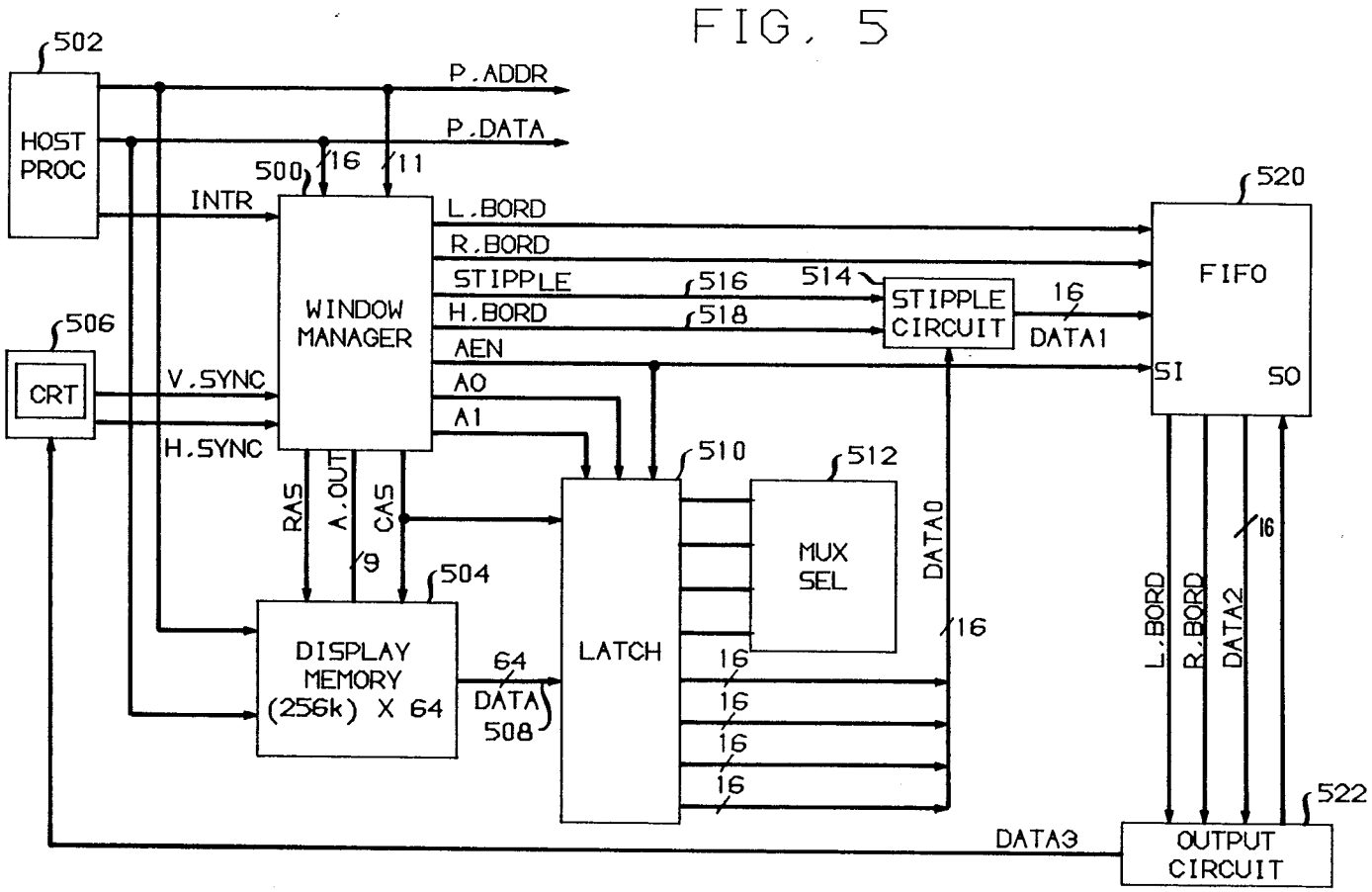
FIG. 5 is an illustrative block diagram of the overall graphics workstation including a window manager circuit.

FIG. 5 shows a block diagram of the overall system. A window manager 500 interconnects a host processor or microprocessor 502, a display memory 504, a display screen 506 and a number of output circuits. Processor 502 writes display data into the display memory 504 via address and data busses P.ADDR and P.DATA. Signals on lead INTR from window manager 500 to processor 502 tell the processor when it is okay to write. In addition, processor 502 writes data into internal registers of window manager 500 to control from where display data is retrieved for each window during raster scanning of display 506. Display memory 504 is illustratively a 256K by 64 bit memory (1K=1024 bits). Data is outputted from memory 504 on bus 508 in 64 bit words. The slash in 508 indicates a multilead bus, and the number beside the slash indicates the number of leads in the bus. This notation is used throughout the disclosure. An input read address bus A.OUT extending from the window manager 500 to display memory 504, however, is only 9 bits wide, whereas 18 address bits are required to address 256K 64-bit words. Therefore, two operations are required to specify the required 18 address bits. A signal on lead RAS (row address signal) signals the first operation and a signal on lead CAS (column address signal) signals the second operation.

A 64-bit word from display memory 504 illustratively comprises data for four 16-bit contiguous cells on the display screen. The entire word is inputted into a latch 510 and the data for the individual cells metered out at appropriate times under control of a multiplexer select circuit 512. Circuit 512 is, in turn, controlled by signals on an address enable lead AEN and two address select leads A0 and A1, which identify the particular 16-bit word to be selected from the 64-bit word.

The cell data from latch 510 is routed into a stipple circuit 514 on bus DATA0. This circuit is controlled by STIPPLE signals on bus 516 and by a horizontal border detection signal H.BORD on lead 518 from the window manager 500 to add desired selective background textures onto the screen to individual windows and to add the horizontal portions of screen borders to the windows, if desired.

The screen data from memory 504, now modulated with stipple and horizontal border data as needed, is inputted into a first-in-first-out buffer 520 from bus DATA1 under control of signals at its shift-in (SI) input and from there outputted to an output circuit 522 under control of signals at its shift-out (SO) input. Before outputting, however, circuit 522 adds vertical window border signals to the data, as required, in accordance with the state of left and right vertical bonded signals on leads L.BORD and R.BORD. From circuit 522, display data is sent serially to the display device 506 on lead DATA3.

Figure 6:
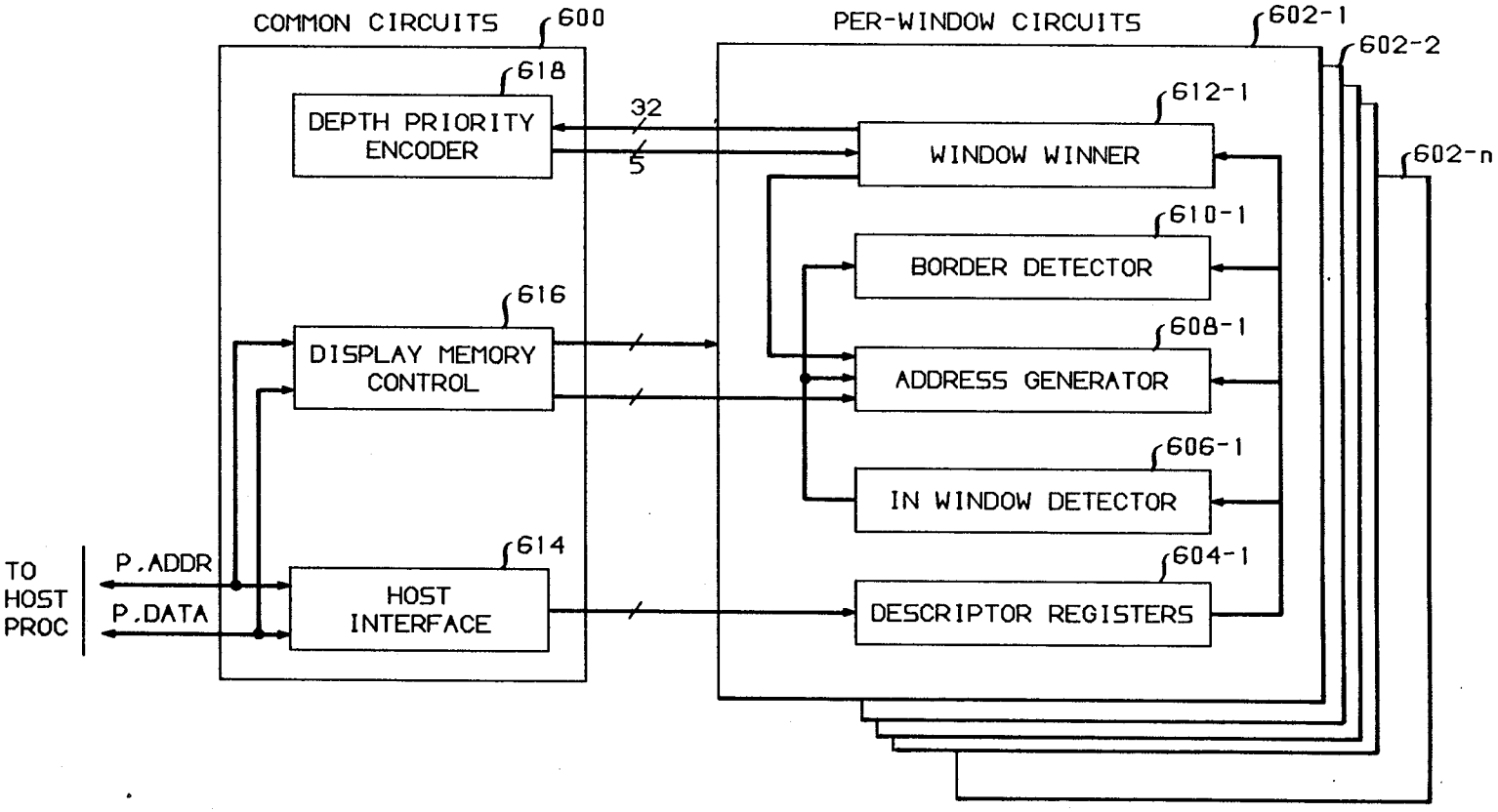
FIG. 6 is an illustrative block diagram of the window manager, including individual per window circuits and common circuits.

A more detailed block diagram of the window manager 500 is shown in FIG. 6. It comprises a common section 600 which interacts with a plurality (up to sixteen in the exemplary embodiment) of per window sections 602-1 through 602-n. A host interface circuit 614 provides the connection to a host processor 502. Each per window section may be associated with an individual window defined at any given time. Since the per window sections are identical, only the details of 602-1 are shown. A descriptor registers circuit 604-1 contains a number of registers defining the screen boundaries, border, stipple and depth of the associated window. These registers are loaded by the host processor via a host interface circuit 614 in the common section. An address generator 608-1 in the per window section uses the register data from circuit 604-1 to generate bitmap addresses for fetching screen data for the associated window. This address data is only used, however, when the respective window is actively being scanned on the screen. To determine which window, if any, is actively being scanned, a depth priority encoder 618 in the common section continuously interacts with window winner circuits such as 612-1 in each of the per window sections to determine a window with the highest depth at the point on the screen presently being scanned. The "in window" circuit 606-1 in each per window section determines from window definition data and screen position data if the associated window is presently being scanned on the screen. At the same time, the individual window winner circuits obtain respective depth information from the respective descriptor circuits, such as 604-1 and broadcasts this information to the depth priority encoder 618. Circuit 618, in turn, determines the highest depth window at any given time and returns this information to each of the window winner circuits in the per window sections. Outputs from the window winner circuits 612 and the "in window" detectors 606 are examined by the respective address generators 608. If the window area being scanned on the screen is also identified as the present winner, the appropriate address generator 608 is enabled and generates and passes appropriate bitmap addresses to the display memory control circuit 616 for fetching the screen update information.

A border detector 610 in each of the per window circuits detects when border areas of windows are being replaced, if borders are defined, and controls the generation of special signals to create the borders on the screen. Thus, data for creating the window borders is not stored in the bitmaps. The reason for this will become apparent below.

Figure 8:
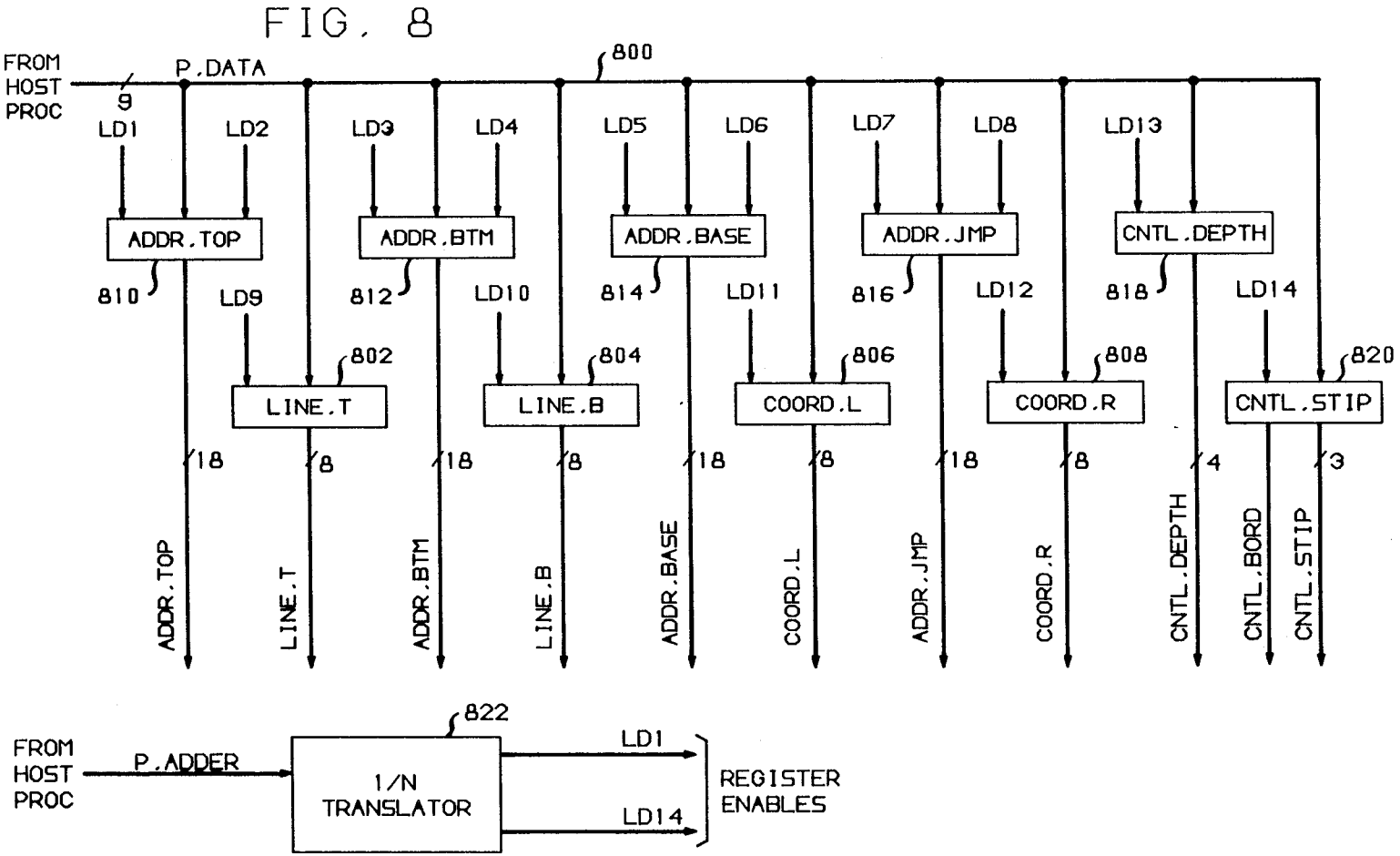
FIG. 8 illustrates a per window circuit that stores data defining the boundaries of a window, bitmap data for generating bitmap addresses and window depth and stipple data.

These individual circuits are now described in detail. A descriptor registers circuit 604 is shown in FIG. 8. When a window is first defined, the defining data arrives on the P.DATA bus 800 from the host processor 502 and is loaded into the registers 802, 804, 806 and 808. These registers are respectively identified as LINE.T, LINE.B, COORD.L, and COORD.R and contain the screen parameters of the window as shown in FIG. 1. When a window is first defined, the host processor also determines the bitmap addresses for the parameters ADDR.TOP, ADDR.BTM, ADDR.BASE and ADDR.JMP, shown in FIGS. 3 and 4, and loads these into the respective registers 810, 812, 814 and 816. Two remaining registers CNTL.DEPTH and CNTL.STIP are loaded with numbers that define the depth of a window and a background texture (stipple) for the window as displayed on the screen. These are user preferences and may be changed by a user at any time by entering appropriate commands to the host processor. To load the appropriate data into the correct registers, a register address is transmitted on address bus P.ADDR with each set of register data from the host interface. A 1-out-of-N translator 822 decodes the P.ADDR address into an enable signal LD1 through LD14 which identifies and enables the appropriate register for which the data is intended. Registers 810, 812, 814 and 816 contain the most significant eighteen bits of a twenty bit display memory address. Therefore, two data load operations are necessary for these registers, since bus P.DATA is nine bits wide. Accordingly, two different LD signals from translator 822 are used to load each of these registers.

Figure 9:
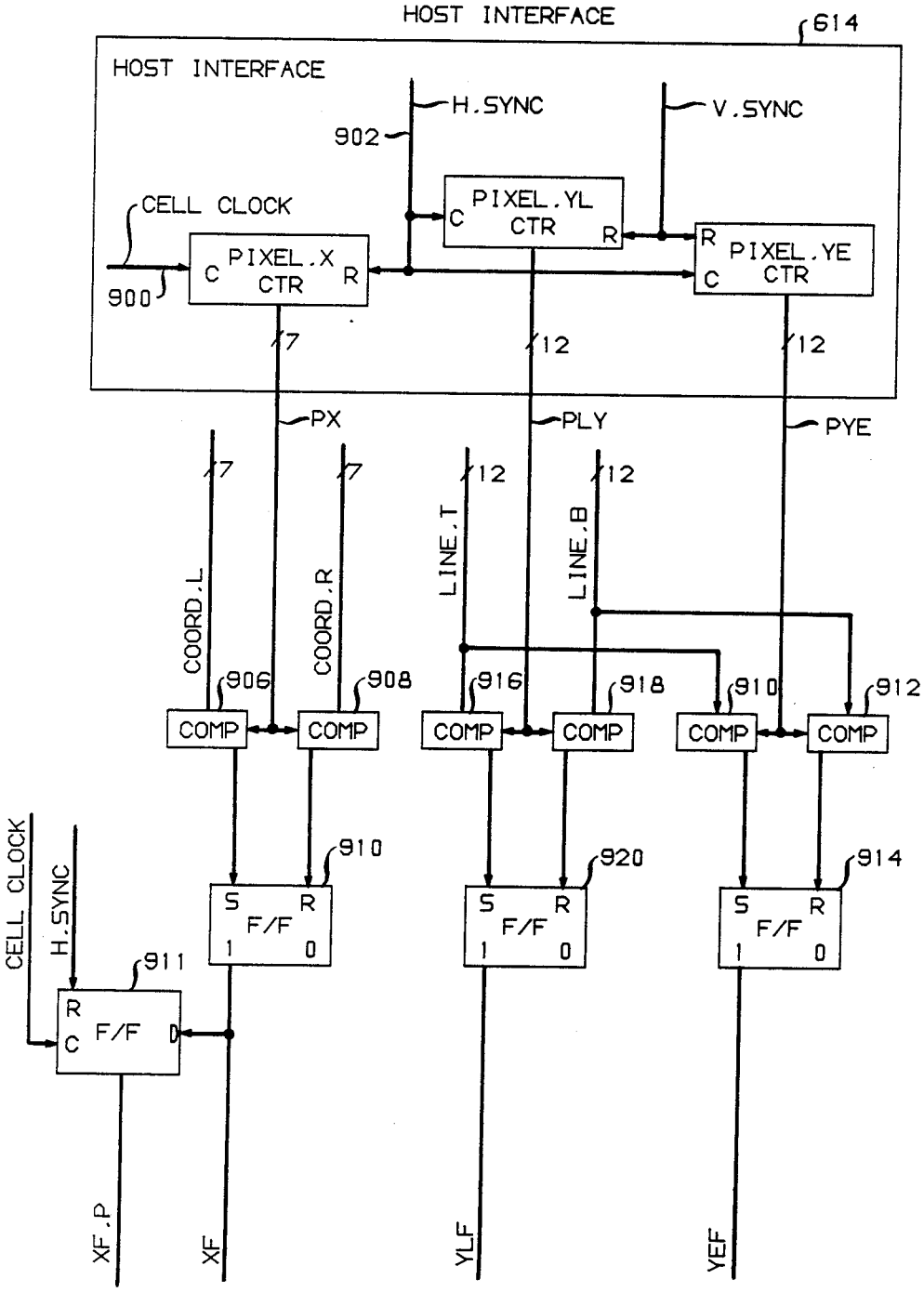
FIG. 9 illustrates a per window circuit for detecting when the associated window is being refreshed on the display device and related circuitry in a common interface circuit to a host precursor.

An "in window" detector is shown in FIG. 9 along with part of the host interface 614. The host interface contains three counters PIXEL.X, PIXEL.YL and PIXEL.YE. PIXEL.X keeps track of the present horizontal cell position presently being displayed on the screen. It is recalled that a cell is illustratively sixteen pixels wide in the preferred embodiment. Thus, the cell clock at 900, which is being counted by PIXEL.X is really the pixel clock divided by sixteen. As the scanning of each screen line is completed, a horizontal sync signal H.SYNC at 902 from the display 506 resets PIXEL.X. The signals on H.SYNC are also counted by screen line counters PIXEL.YL and PIXEL.YE. Both of these counters are reset by a vertical sync signal V.SYNC on lead 904 from the display 506 each time a full screen is completed. PIXEL.YE resets to zero. PIXEL.YL, however, is arranged to reset to a negative four. The reason for having two line counters and the reset value distinction has to do with window border generation, as will be seen.

The cell count is outputted on bus PX to two comparators 906 and 908. Respective secondary inputs to these comparators come from the registers COORD.L and COORD.R in the descriptor registers circuit in FIG. 8. When the screen raster is at the position corresponding to COORD.L, that is entering the window on the left (see FIG. 1), comparator 906 sets a flip-flop 910. This flip-flop is reset by comparator 908 as the window is exited on the right. Thus, flip-flop 910 produces a signal on its output lead XF whenever the screen raster is within the horizontal bounds of the window. This signal is delayed by one cell time by delay flip-flop 911 to generate a delayed signal on output lead XF.P. This signal is used by border detector 610 to define the raster time corresponding to a vertical left or right window border and is discussed with respect to FIG. 12. Flip-flop 911 is reset at the beginning of each raster line by H.SYNC to prevent any carryover effect from the immediately preceding line.

In a similar fashion as above, comparators 910, 912 and flip-flop 914 generate a signal on output lead YEF whenever the screen raster is within the vertical bounds of the window. A signal on lead YLF is an image of that of YEF, but precedes YEF by four raster lines due to the reset states of PIXEL.YL and PIXEL.YE and to the action of comparators 916, 918 and flip-flop 920.

Figure 15:
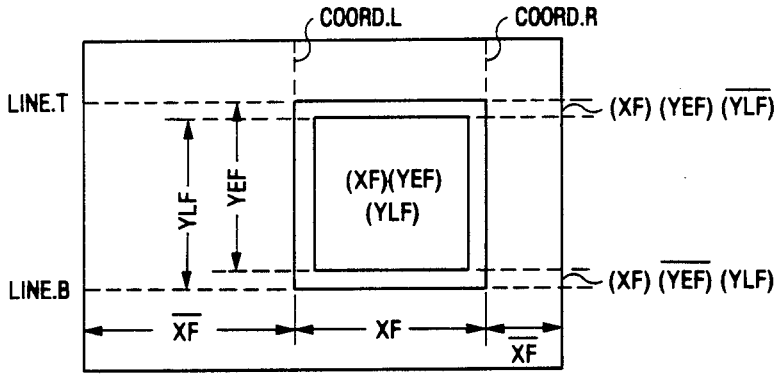
FIG. 15 defines window area and borders in the illustrative embodiment in terms of boolean expressions of signals generated by the disclosed circuitry.

The physical meaning of the above window signals can be seen easily in FIG. 15 which depicts a screen with a single window including a border. In the horizontal scanning direction, XF becomes true when the raster is between COORD.L and COORD.R. Note that for a window with a border, the border is inside these coordinate points. In the vertical direction, YEF is true from LINE.T (including the upper horizontal border, if any) to the bottom line of the inside of the window (i.e., not including the lower horizontal border). Conversely, YLF is true between the upper window line, not including the upper horizontal border, to the bottom line, including the bottom border. Thus, the inside of a bordered window is defined by the boolean expression (XF)(YEF)(YLF). The upper border, if any, is being scanned when the boolean expression $(XF)(YEF)(\overline{YLF})$ is true. The bottom border, if any, is being scanned when the boolean expression $(XF)(\overline{YEF})(YLF)$ is true. The vertical left and right borders are not defined by boolean expressions, but are handled by one-quarter cell timing delays when signal XF transitions from true to false and from false to true, as will be seen.

Figure 10:
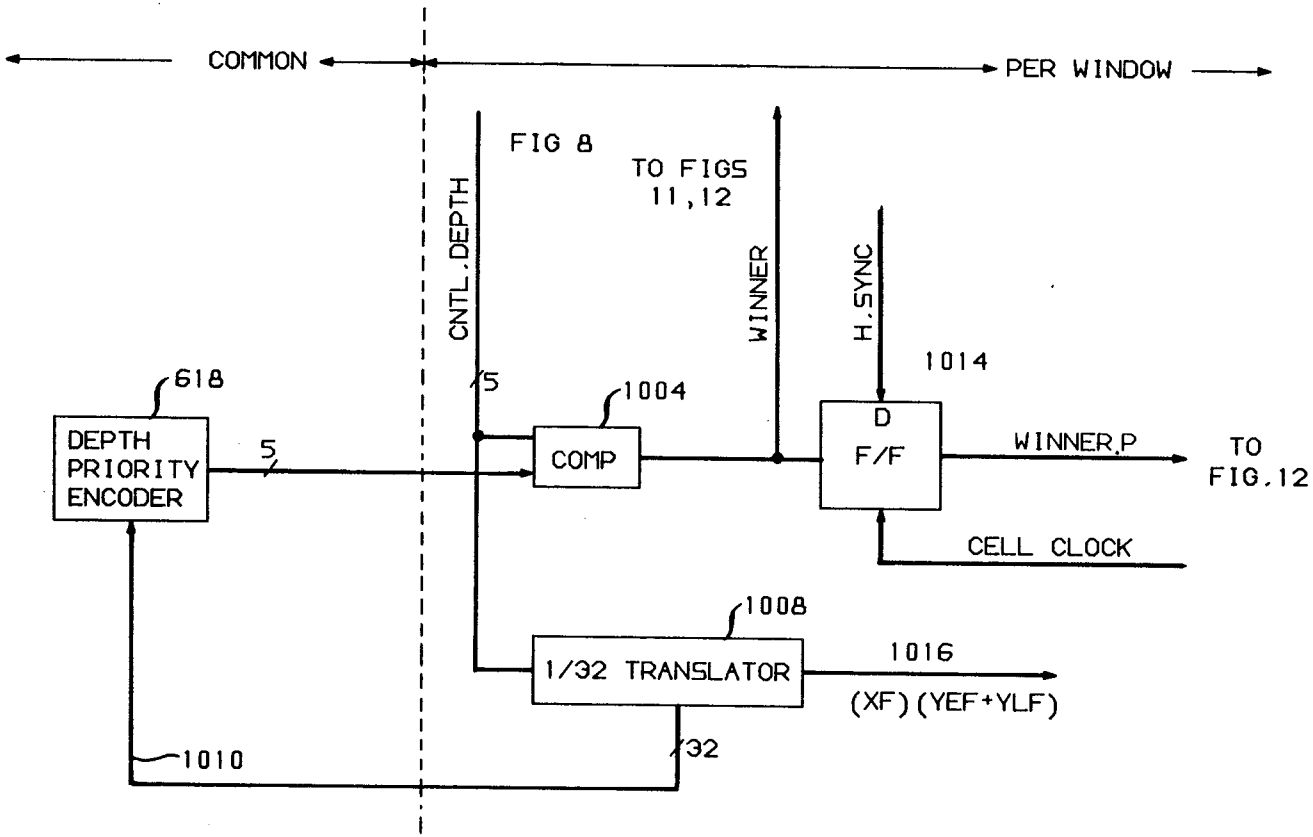
FIG. 10 illustrates common and per window circuitry for determining which, if any, window is being refreshed on the display device.

A window winner circuit 612 is shown on the right side of FIG. 10. The left side, separated by a vertical dotted line, is the depth priority encoder 618 in the common section of the window manager. A five lead bus 1000 extends to each of the individual window circuits. A multiple on bus 1000 to each of the other per window sections is shown at 1002. On the right side of FIG. 10, an indication of the depth of a window is brought into a comparator 1004 on bus 1006 from the descriptor registers circuit in FIG. 8. This depth indication is also received and decoded into a 1-out-of-32 signal by translator 1008, if translator 1008 is enabled, and a resulting signal is placed onto an appropriate lead of bus 1010 extending back to the depth priority encoder 618. Translator 1008 is enabled by a signal on lead 1016 generated from "in window" detector signals in FIG. 9 which, as indicated by the boolean equation (XF)(YEF+YLF), occurs whenever the display raster is inside a window.

Bus 1010 is also multiplied to the other per window circuits as indicated at multiple 1012. Encoder 618 determines the highest priority signal present on bus 1010 at any time and returns an indication of this on bus 1002 in the same format as the depth indications received from the descriptor registers circuit. Comparator 1004 in each per window circuit compares the highest priority indication from encoder 618 to its window depth and generates a signal on lead WINNER if a match is detected. This signal is also delayed by one cell time by flip-flop 1014 to produce a signal WINNER.P. WINNER.P is also used by the border generator shown in FIG. 12.

There is always a winning window in the preferred embodiment. Host processor 502 defines a default window if a user fails to do so.

Figure 11:
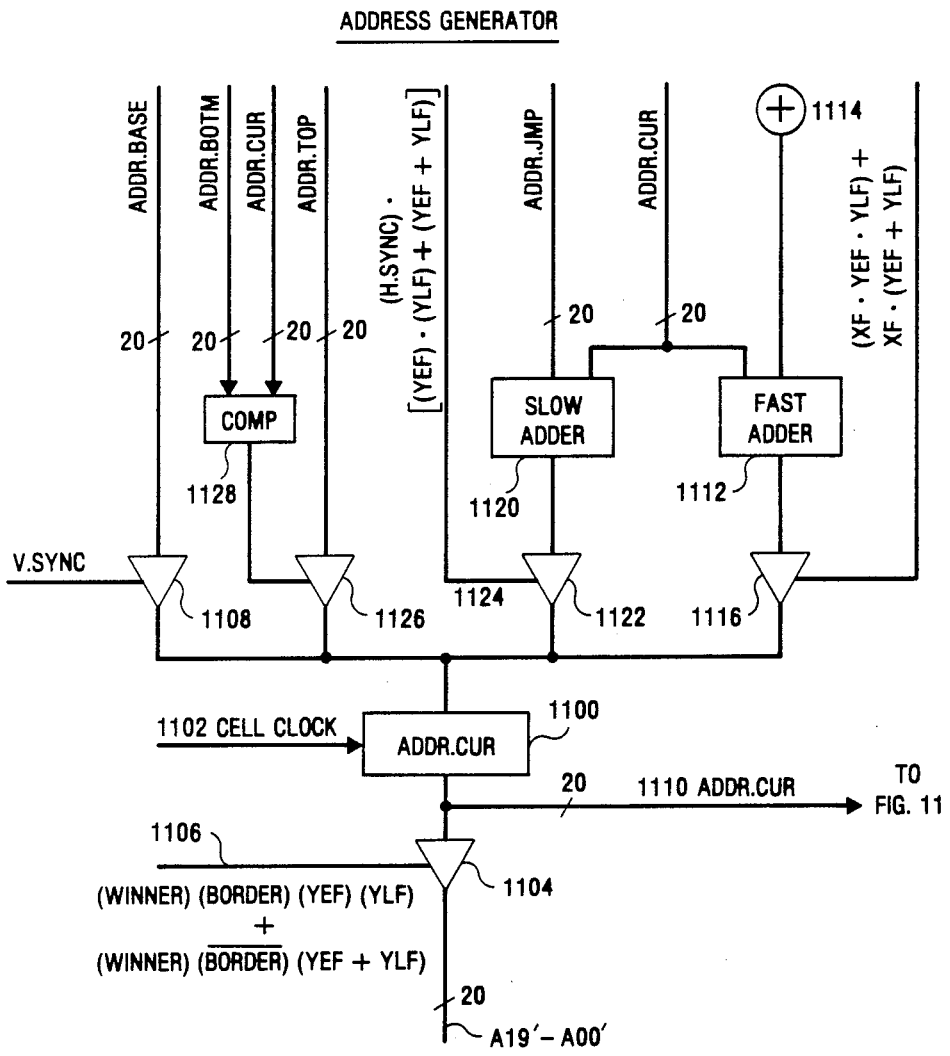
FIG. 11 shows an illustrative per window bitmap address generator.
Figure 12:
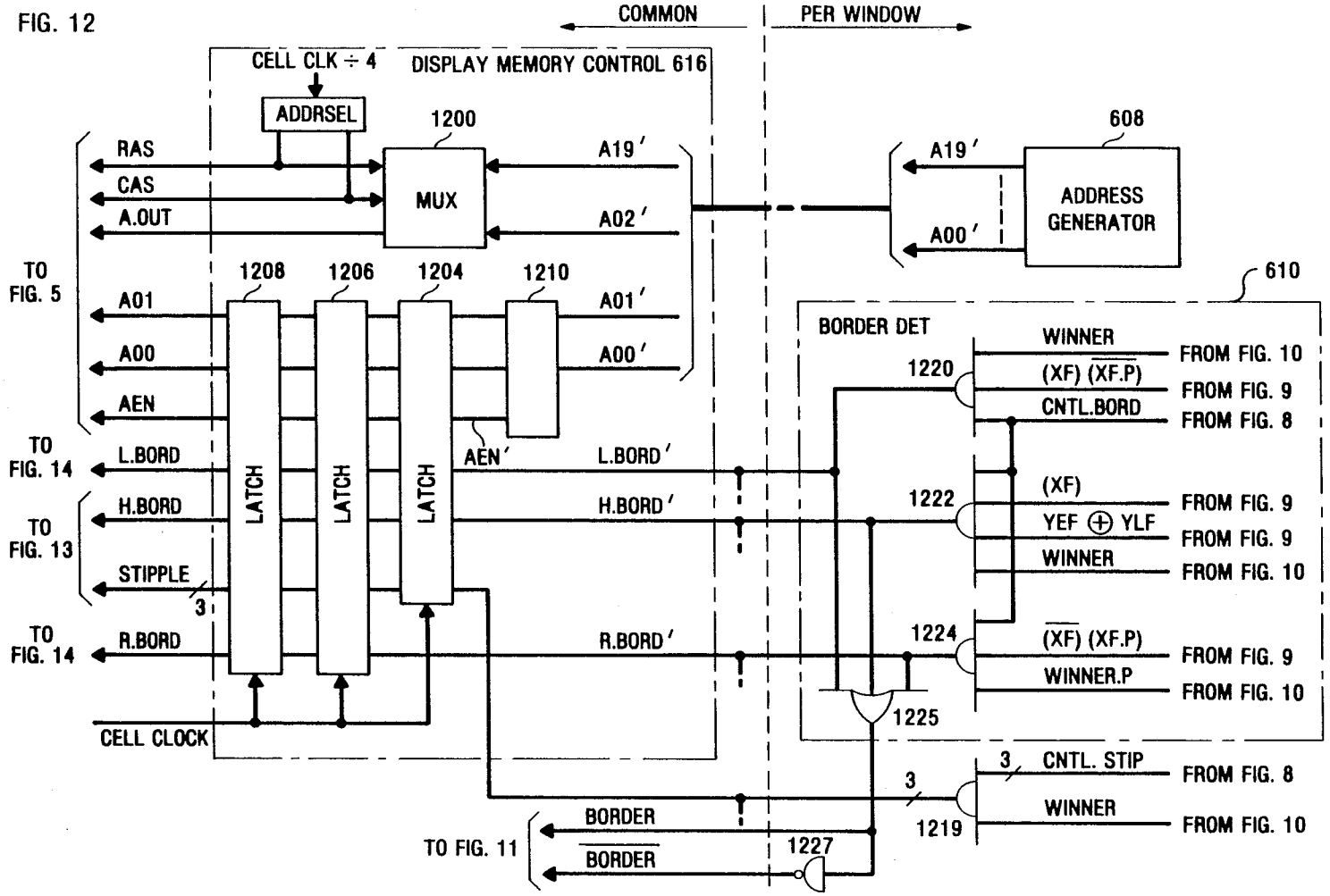
FIG. 12 shows an illustrative output control circuit as part of the common circuitry and a window border detector that identifies when a window border is being refreshed on the display device.

Address generator 608, shown in FIG. 11, in each per window circuit uses the "in window" signals from FIG. 9 and the WINNER signal from FIG. 10 to generate bitmap addresses. Present bitmap address is maintained in a register ADDR.CUR 1100. The cell clock signal appearing on lead 1102 loads an address into register 1100 from one of the sources in the upper part of FIG. 11 at the beginning of each cell time. An output driver 1104 gates the address in register 1100 to the bitmap address leads A19' through A00' at the proper times and thence to the common portion of the window manager. Enable signals appearing on lead 1106 to driver 1104 determine when addresses are gated to these address leads. The upper boolean enabling term (WINNER)-(BORDER)(YEF)(YLF), shown on lead 1106 in FIG. 11, activates driver 1104 when this window is determined to be the highest depth and a border is present. Circuitry for generating the BORDER signal is shown in FIG. 12. (YEF)(YLF) insures that the screen area being scanned is inside the border area. The signal WINNER is true only when XF is present. This insures that the horizontal line portion being scanned is also within the window. The bottom enabling term on lead 1106, (WINNER)($\overline{\text{BORDER}}$)(YEF+YLF), enables address outputting for the entire window, including the normal border areas, when no border is present.

At the beginning of a screen scan, the vertical sync signal V.SYNC enables a driver 1108, which gates the base address of this window into register 1100. This prepares the starting bitmap memory address when the raster first enters the window. In addition to being gated to the address bus at appropriate times, the contents of ADDR.CUR are returned on lead 1110 to one input of a fast adding circuit 1112 at the upper right corner of FIG. 11. A second input of adder 1112 is attached to a positive voltage at 1114. This causes adder 1112 to increment the address from ADDR.CUR by one. This incremented address is returned and loaded into register 1100 at the beginning of each cell time while driver 1116 is enabled. The signals appearing on enabling lead 1118 follow the boolean expression (XF) (YEF) (YLF)+(XF) (YEF+YLF), which is true when the screen raster is inside the border and/or window area. It may be helpful to now refer to FIG. 14 which identifies the various parts of a window with appropriate boolean expressions. This arrangement increments ADDR.CUR 1100 each cell time to move sequentially through the bitmap until the raster leaves the right side edge of the window on the present screen line. When the raster moves out of the window on the right side of the screen, a jump in the bitmap address is made to the proper address associated with the left side of the window in the next screen line. A slow adder is used for this purpose, since time is available for address update until the raster actually arrives at the next window left edge. Slow adder 1120 adds the contents of register ADDR.JMP (see FIGS. 3 and 4) to the current address. At the beginning of the next screen line, assuming that this line is still within the window, driver 1122 is enabled by the signal on lead 1124, (H.SYNC) ((YEF) (YLF)+(YEF+YLF)), and gates the new address into ADDR.CUR.

Similarly, driver 1126 gates the beginning bitmap address into ADDR.CUR when it becomes necessary to loop from the bottom of the bitmap (ADDR.BOTM in FIGS. 3 and 4) to the beginning of the bitmap (ADDR.TOP). To accomplish this, comparator 1128 compares the contents of register ADDR.BOT in the descriptor registers circuit with ADDR.CUR and enables driver 1126 when a match occurs.

FIG. 12 shows the display memory control 616 in the common circuitry and per window circuitry that cooperate to control the generation of window borders. The interface between the bitmap address generator 608 and the common circuitry is also shown. The common and per window sections are shown on the left and right of FIG. 12, respectively. First, the bitmap addressing is described. Assuming that the per window circuit shown on the right of FIG. 12 is that of the winner at any given time, an appropriate address appears on the leads A19' to A00' as before described. Leads A19' through A02' appear at the input of a multiplexing circuit 1200 in display memory control 616. Two other inputs to multiplexer 1200 are the display memory row and column signals on leads RAS and CAS. These signals are generated by an address select circuit 1202. The purpose of multiplexer 1200 and address select 1202 is to partition the address on leads A19' through A02' into two parts and to multiplex the two parts onto a nine lead address bus A.OUT. As shown in FIG. 5, A.OUT extends to the display memory 504. Address select 1202 merely toggles signals on RAS and CAS at proper times based on the word clock to accomplish this purpose.

Border detector 610, shown on the right of FIG. 12, generates signals whenever the raster coincides with a border area of a winning window. These signals cause the automatic generation of raster border signals which are modulated into the display signal stream instead of signals from display memory 504. Specifically, gates 1220, 1222 and 1224 are enabled by a signal CNTL.BORD from the descriptor register circuit in FIG. 8 if this particular window circuit has a border defined. Whenever this window circuit is the highest depth priority (WINNER true) and the raster is within the left vertical border area as defined by the boolean equation (LF) (LF.P), gate 1220 activates lead L.BORD'. Similarly, gates 1222 and 1224 activate leads H.BORD' and R.BORD', respectively, when horizontal and right vertical border areas are detected for this winning circuit. L.BORD', R.BORD, and H.BORD are combined by an OR gate 1225 to generate the above-mentioned signal $\overline{\text{BORDER}}$. NAND gate 1227 complements BORDER to form $\overline{\text{BORDER}}$ According to the inputs to gates 1224, the R.BORD signal is generated as the window is exited on the right. To now generate the right vertical border on the screen just before the window is exited requires that the actual screen signals be generated after detecting such a window exit. This is accomplished by latch circuits described immediately below.

L.BORD' and H.BORD' are inputted to the first of three cascaded latch stages 1204, 1206 and 1208 in the display memory control. R.BORD', however, is inputted to the second latch stage 1206. Similarly, the least significant address leads A01' and A00' from address generator 608 are inputted to the first latch stage 1204 via a circuit 1210. Circuit 1210 decodes the A00' and A01' signals to generate the address enable signal AEN, which is also inputted to the first delay stage 1204. The corresponding output signals from the third stage 1208, A00, A01, AEN, L.BORD, H.BORD and R.BORD are the signals actually used for controlling the screen image. A given cell clock signal at latch 1204 gates in the states of its inputs. Two cell clock signals later, these states appear at the output of latch 1208. The one cell difference in delay between R.BORD and L.BORD created by latches 1206 and 1204 is used by the output current 522 to create right edge window borders, as will be seen.

An AND gate 1219 in the per window circuitry is enabled when the associated window is the winning window. This causes stipple pattern select signals from the descriptor registers to also be gated to the input of first latch 1204. The corresponding delayed output signals appear at the output STIPPLE of latch 1208 in synchronizing with the above-described signals for controlling the actual display of data.

Figure 13:
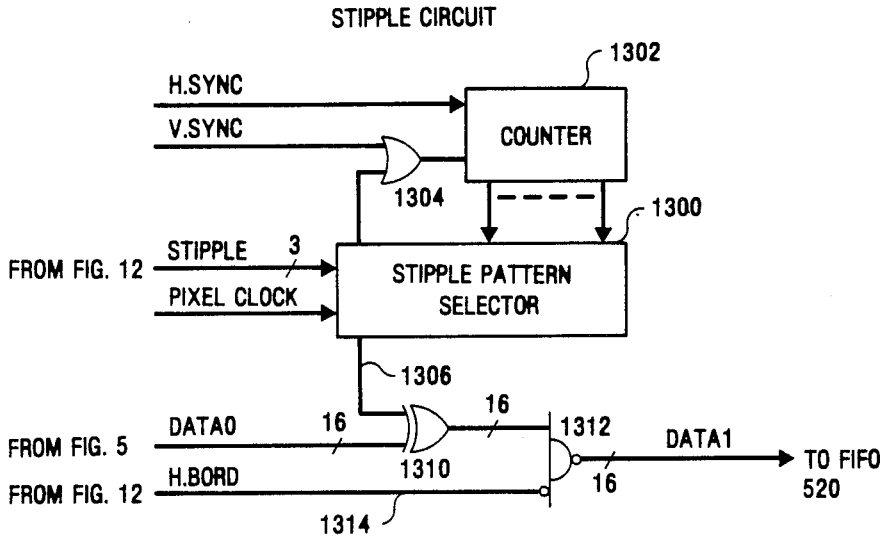
FIG. 13 illustrates an exemplary circuit for generating window background (stipple) patterns.

Horizontal border generation on the screen, as well as background window stipple patterns are generated by the stipple circuit 514. The details of circuit 514 are shown in FIG. 13.

A stipple pattern selected circuit 1300 receives the STIPPLE signals to select the pattern for the associated window. A counter 1302 is used to keep track of the pixel spacing between the stipples (e.g., data). Counter 1302 is reset at the beginning of a screen by V.SYNC which is applied to the counter via OR gate 1304. H.SYNC increments counter 1302. Selector 1300 reads the counter outputs to detect when a stipple should be inserted into the display data stream (or determined by the selected stipple pattern). When this occurs, selector 1300 applies a data signal to lead 1306 and a signal to lead 1308 to reset counter 1302. The signal on lead 1306 is injected into the display data stream on DATA0 by an EXCLUSIVE OR gate 1310. The output of gate 1310 extends to a NAND gate 1310. The output of gate 1310 extends to a NAND gate 1312 which outputs the stream to bus DATA1. Bus DATA1 extends to FIFO 520 where the data signals are temporarily stored. Signals for creating a horizontal border on the display device are injected at gate 1312 whenever a H.BORD signal appears on lead 1314.

Figure 14:
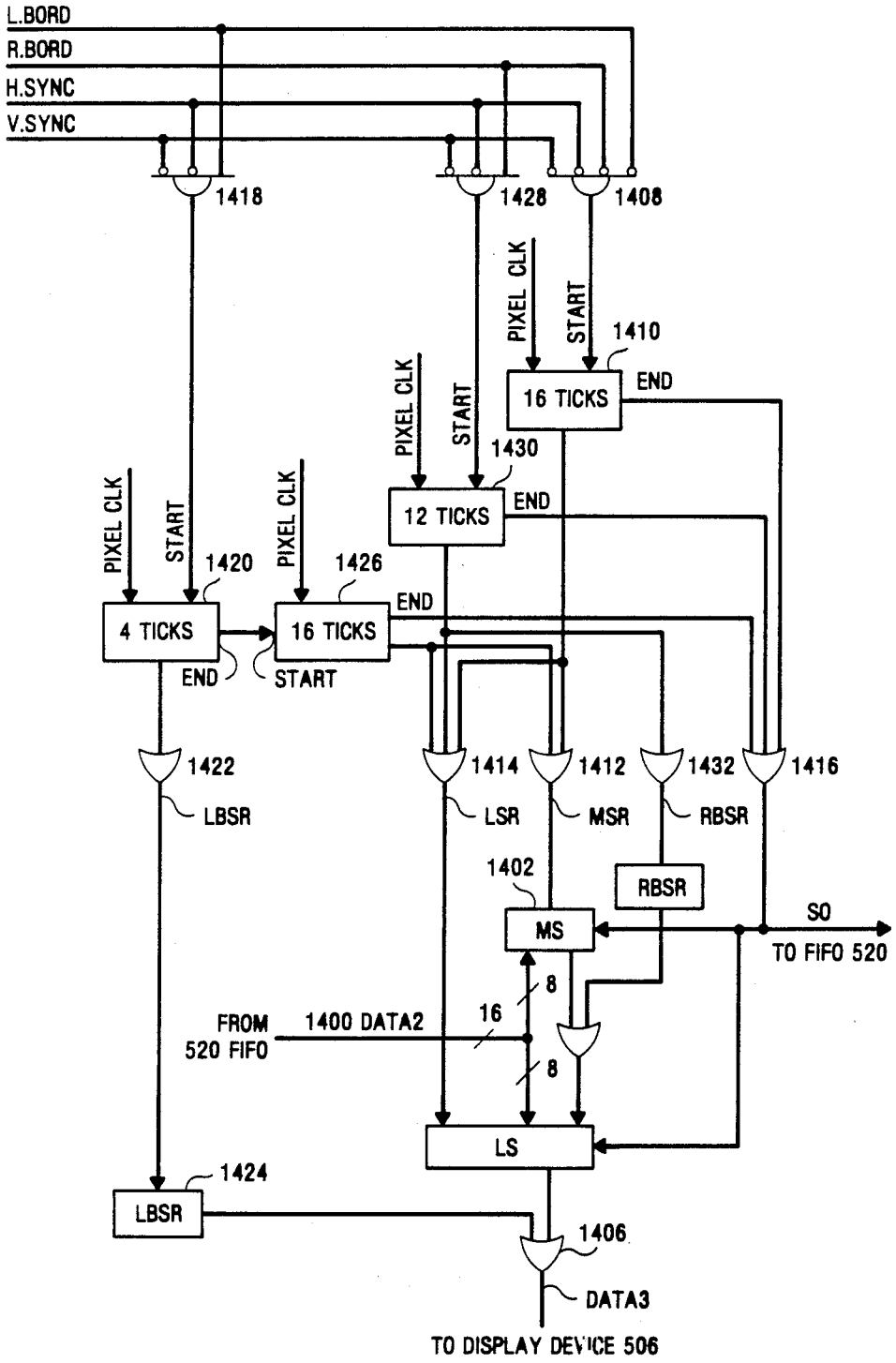
FIG. 14 illustrates an exemplary output shift register circuit that generates vertical window border data and transmits this data and etched display data to the display device.

The output control 522 in FIG. 14 performs the final operations to generate the vertical window borders. Cell data from FIFO 520 appears on incoming bus 1400 in sixteen bit parallel format. The eight most significant of these bits are inputted to a shift register 1402 and the eight least significant bits are put into another shift register 1404, both under control of a shift out signal SO, described below. When no border considerations are present, signals on leads LSR and MSR cause the data to be shifted out serially from SR 1404 to the display device 506 via OR gate 1406 and simultaneously from SR 1402 to SR 1404.

Signals on leads LSR and MSR are generated as follows. Gate 1408 is activated when neither L.BORD or R.BORD is present. An output signal of gate 1408 activates a tick circuit 1410. Circuit 1410, in turn, then outputs a stream of sixteen pulses to OR gates 1412 and 1414 in synchronism with pixel clock pulses to shift out one cell of data from SRs 1402 and 1404. At the end of the sixteen pulse stream, tick circuit applies a signal to OR gate 1416 to generate the SO signal. This signal is returned to FIFO 520 to gate out another cell of data. Simultaneously, it gates that data into SRs 1402 and 1404. When a left-edge border is detected L.BORD activates gate 1418, which, in turn, activates tick circuit 1420. Four pulses are applied to OR gate 1422 as a result. The resulting four signals on lead LBSR shift out four fixed signals from a SR 1424 to inject a four pixel wide portion of a vertical border. At the end of this interval, tick circuit 1420 activates tick circuit 1426, which pulses gates 1412 and 1414 to shift out another cell of data from SRs 1402 and 1404. When this is accomplished, circuit 1426 pulses OR gate 1416 to generate SO. Gate 1428 is activated when a right-edge border is detected. In response, tick circuit 1430 generates 12 tick pulses. The first eight of these cause eight data bits to be outputted from the least significant SR 1404. Simultaneously, twelve border signals are shifted into SR 1404 by the tick signals applied to OR gate 1432. The first four of these border signals will eventually be outputted from SR 1404 to the data stream. The remaining will be replaced by new cell data from FIFO 520, as described.

It is to be understood that the above-described arrangements are merely illustrative of the many possible specific embodiments which can be devised to represent application of the principles of the invention. Numerous and varied other arrangements can be devised in accordance with these principles by those skilled in the art without departing from the spirit and scope of the invention.

What is claimed is:

1. A bitmapped graphics workstation comprising a host processor, a visual output display device having a raster scanned display screen, means for defining a plurality of independent window areas on the screen, a plurality of bitmap memories each having contiguous storage words addressable by the host processor for storing display data associated with a different said window, means responsive to the window defining means for identifying when the screen raster enters and exits one of the windows, means activated by the identifying means for retrieving display data from one of the bitmap memories associated with the one window, means for transmitting the retrieved display data to the display device in synchronism with the raster, and means responsive to the detection of entry and exit of the raster in the window by the identifying means for substituting for a predetermined number of the data signals from the one bitmap signals of a predetermined state for generating the window border.

2. The invention of claim 1 wherein the means for defining further comprises a plurality of descriptor registers for storing data defining window boundaries on the display screen and the identifying means further comprises means responsive to window boundary data from the descriptor registers for generating border detection signals indicating that a border area of the window is to be refreshed on the screen.

3. The invention of claim 2 wherein the border detection signals comprise a horizontal border detection signal, a left vertical border detection signal and a right vertical border detection signal.

4. The invention of claim 3 wherein the means for retrieving display data further comprises means for delaying bitmap read address signals and the horizontal and right vertical border detection signals by a prescribed amount of time, means for delaying the left vertical border detection signal by a time interval which is less by a predetermined amount than the prescribed delay time of the right vertical border detection signal, wherein the transmitting means receives display data accessed by the delayed bitmap read address signals for transmission to the display device and includes means responsive to a delayed horizontal border detection signal for injecting a prescribed number of horizontal border signals into the display data stream, and means responsive to the delayed left and right vertical border detection signals for injecting a predetermined number of vertical border signals into the display data stream.

5. A bitmapped graphics workstation comprising a host processor, a visual output display device having a raster scanned display screen, and a window manager circuit for defining a plurality of display windows on the screen of the display device and for controlling the display of information in the windows, the window manager circuit having common circuitry and a plurality of per window circuits, each per window circuit having means for defining screen boundaries of its associated window, means responsive to the window boundary defining means for detecting when the raster is refreshing a screen area associated with its window, means responsive to the detecting means for generating bitmap read addresses, and means responsive to the detecting means and to the screen boundary defining means for generating horizontal border detection signals, left vertical border detection signals and right vertical border detection signals when the respective border areas of the window are being refreshed, and the common circuitry includes means for delaying the bitmap read address signals and the horizontal and right vertical border detection signals by a first prescribed amount and for delaying the left vertical border detection signals by a second prescribed amount less than the first prescribed amount by at least the refresh time associated with the width of a vertical border, and output means responsive to delayed display data accessed by the delayed bitmap read address signals for generating and transmitting display data to the display device, the output means also being responsive to the delayed border detection signals for substituting predefined border generation signals into the display data in place of bitmap data.

6. The invention of claim 5 wherein each per window circuit further comprises means for storing an indication of an abstract layer on the screen in which the associated window resides, means cooperative with the common circuitry and the detecting means for determining if the window is at the highest screen layer at the portion of the window being refreshed, and wherein the detecting means is further responsive to the determining means to determine if this per window circuit should control the screen refreshing.

7. The invention of claim 6 wherein the output means further comprises first means for receiving the delayed display data and being responsive to the delayed horizontal border detection signals for substituting horizontal border generation signals into the delayed display data.

8. The invention of claim 7 wherein the output means further comprises second means for buffering display data from the first means.

9. The invention of claim 8 wherein the output means further comprises shift register output means for receiving display data from the buffering means and being responsive to the delayed left and right vertical border detection signals for substituting into the display data left and right border generation signals.

10. The invention of claim 9 wherein display data is obtained from the bitmaps in blocks of a fixed number of bits corresponding to a displayable cell on the screen consisting of a like number of pixels, and wherein the first and second output means both comprise means for processing the blocks of display data.

11. The invention of claim 10 wherein the shift register output means further comprises means for storing blocks of display data from the second output means and for outputting the stored blocks of data to the display device as a serial stream of bits.

12. The invention of claim 11 wherein the means for storing blocks further comprises first shift register means for receiving the most significant half of bits in a block, second shift register means for receiving the least significant half of bits in a block, first means for connecting the serial output of the first shift register means to a serial input of the second shift register means, second means for connecting the serial output of the second shift register means to the display device, third shift register means for storing vertical border generation signals and having a serial output connected to the first connecting means, fourth shift register means for storing vertical border generation signals and having a serial output connected to the second connection means, and logic means responsive to the border detection signals for controlling the first through the fourth shift register means to substitute border generation signals into the data stream to the display device.

13. The invention of claim 12 wherein the logic controlling means further comprises first controlling means responsive to the absence of a delayed border detection signal for controlling the output of a full block of bits from the first and second shift registers, second controlling means responsive to a delayed left vertical border detection signal for controlling the fourth shift register to output a predefined number of vertical border generating signals, third controlling means responsive to a signal from the second controlling means for controlling the output of a full block of bits from the first and second shift registers after the generation of the vertical border signals, and fourth controlling means responsive to a delayed right vertical border detection for controlling the output of border generation signals from the fourth shift register to the second shift register and for simultaneously controlling the output from the second shift register of a plurality of bits equal in number to the number of bits in a block minus the predefined number of bits in across the width of a vertical border.

14. The invention of claim 13 wherein the first through the fourth controlling means further comprises means for serially generating predetermined numbers of pulses for enabling shift operations of above-identified ones of the first through the fourth shift registers.

15. The invention of claim 14 wherein each of the first through the fourth controlling means further comprises means for generating an end signal at the termination of each enabling shift operation, and the output controlling means further comprises means responsive to each of the end signals for generating a block read signal to the second output means.

* * * * *